US007744053B2

(12) United States Patent
Perman

(10) Patent No.: US 7,744,053 B2
(45) Date of Patent: Jun. 29, 2010

(54) BOTTLE HOLDER

(76) Inventor: David Michael Perman, 5942 Balboa Dr., Oakland, CA (US) 94611

( * ) Notice: Subject to any disclaimer, the term of this patent is extended or adjusted under 35 U.S.C. 154(b) by 0 days.

(21) Appl. No.: 12/233,454

(22) Filed: Sep. 18, 2008

(65) Prior Publication Data

US 2010/0012807 A1 Jan. 21, 2010

Related U.S. Application Data

(60) Provisional application No. 61/135,160, filed on Jul. 17, 2008.

(51) Int. Cl.
*A47K 1/08* (2006.01)

(52) U.S. Cl. ..... 248/312

(58) Field of Classification Search ..... 248/312, 248/291.1; 215/396, 398; 294/31.2, 33
See application file for complete search history.

(56) References Cited

U.S. PATENT DOCUMENTS 1,184,608 A * 5/1916 Berger ..... 248/312
1,207,994 A * 12/1916 Parker ..... 232/41 E
1,244,050 A * 10/1917 Grob ..... 248/312
2,463,651 A * 3/1949 Stevens ..... 215/395
6,131,779 A * 10/2000 Gendala ..... 224/148.1
6,352,235 B2 * 3/2002 Cizek ..... 248/692
6,394,329 B1 * 5/2002 Magee ..... 224/678
7,464,907 B1 * 12/2008 Lane ..... 248/205.3

* cited by examiner

*Primary Examiner*—Ramon O Ramirez

(57) ABSTRACT

A bottle holder for holding and conveniently transporting a bottle of the character having a neck portion and an enlarged diameter body portion. The bottle holder can be conveniently affixed to the user's belt or waistband and includes a support body for supporting the bottle. The support body includes a generally U-shaped clip portion having first and second opposing sides that cooperate to form a retention channel that receives the user's belt or waistband and also includes a generally yoke shaped support portion for receiving the neck portion of the bottle. The yoke shaped portion of the body is connected to and extends from the first side of the clip portion at an acute angle slightly less than 90°. The bottle holder also includes a retaining member that is pivotally connected to the support body for movement between a first upraised position and a second lowered position wherein a portion of the retaining member circumscribes the neck portion of the bottle and secures the bottle in position within the yoke portion of the support body.

17 Claims, 2 Drawing Sheets

BOTTLE HOLDER

This application is a Non-Provisional Application based on Provisional Application Ser. No. 61/135,160 filed Jul. 17, 2008.

BACKGROUND OF THE INVENTION

1. Field of the Invention

The present invention relates generally to article support and carrying devices. More particularly the invention concerns a novel supporting device for supporting and transporting bottles such as beverage containers.

2. Discussion of the Prior Art

In recent years there has been marked increase in use of portable bottles containing a variety of liquids including water and various types of beverages. For example, the recent widespread interest in sporting activities such as running, biking, hiking, skateboarding and the like has resulted in the participants of these activities carrying bottled water and energy drinks with them. Additionally, concerns about the purity of drinking water have prompted many people to carry bottled water with them during their daily activities. Due to the cumbersome nature of portable beverage containers there has developed a need for a compact, easy-to-use device that enables hands-free transport of the containers. As will become apparent from the discussion that follows, the apparatus of the present invention uniquely accommodates this need.

A number of bottle holding devices of various configurations have been suggested in the past. Exemplary of such devices is U.S. Pat. No. 5,954,247, issued to Savine et at. This patent discloses a bottle holder that is adapted to engage the neck bottle below the external annular flange of the neck, especially for suspending the bottle by means of a cord connected to the neck of a person.

Another prior art bottle holder is disclosed and U.S. Pat. No. 6,543,825 issued to Dragutin. This bottle holder is designed to support a plastic bottle that is awkward to incline in order to pour its content because the bottle lies awkwardly in the user's hands.

Still another bottle holder that comprises a combination bottle hook and wrench is disclosed in U.S. Pat. No. 6,352,235 issued to Cizek.

SUMMARY OF THE INVENTION

By way of brief summary, one form of the bottle holder of the present invention for holding a bottle having a neck portion and an enlarged diameter body portion comprises a one-piece, integrally formed support body for supporting the bottle that includes a generally U-shaped clip portion having first and second opposing sides that cooperate to form a retention channel and a generally yoke shaped support portion for receiving the neck portion of the bottle. In the preferred form of the invention, the yoke shaped portion of the body is connected to and extends from the first side of the clip portion at an acute angle. The bottle holder also includes a retaining member that is pivotally connected to the support body for movement between a first upraised position and a second lowered position wherein it circumscribes the neck portion of the bottle.

With the forgoing in mind, it is an object of the present invention to provide a bottle holder that: enables the bottle to be conveniently secured to the user's clothing such as at the belt or waist band.

Another object of the invention is to provide a bottle holder of the aforementioned character that is of simple construction, is easy to use and keeps the user's hands free during the conduct of normal activities.

Another object of the invention is to provide a bottle holder of the class described that can securely hold conventional plastic bottles of different sizes and shapes.

Another object of the invention is to provide a bottle holder of the character described in the preceding paragraphs that is lightweight, compact and reliable in use.

These and other objects of the invention are realized by the novel bottle holder illustrated in the drawings annexed hereto and described in the paragraphs that follow.

DESCRIPTION OF THE INVENTION

Figure 1:
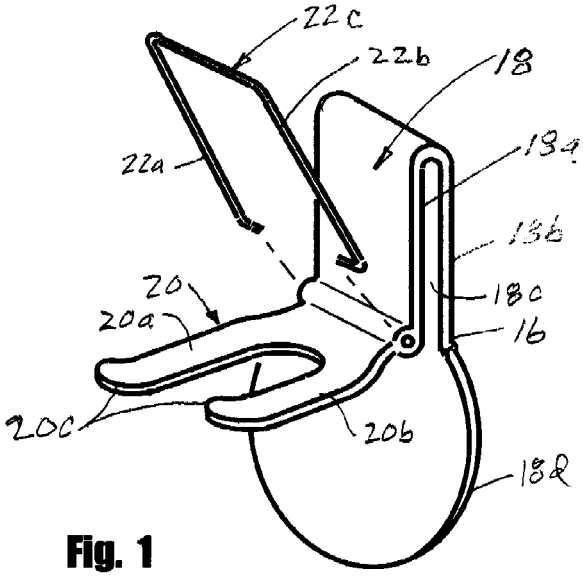
FIG. 1 is a generally perspective, exploded view of one form of the bottle holder of the invention.
Figure 2:
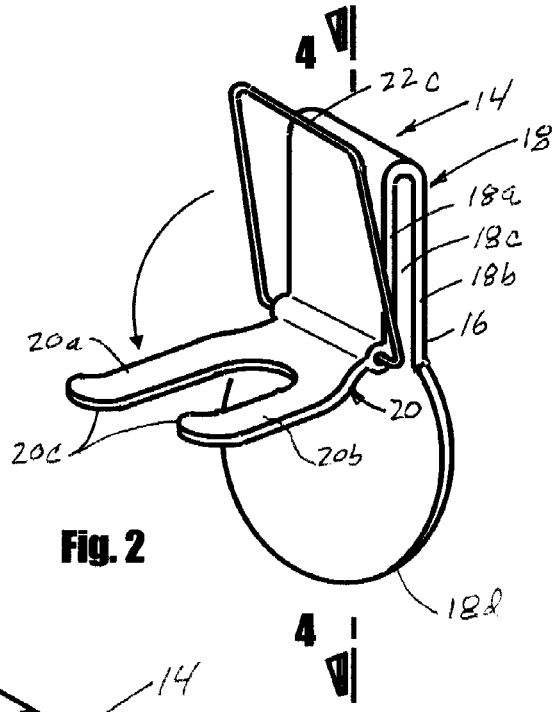
FIG. 2 is a generally perspective view, similar to FIG. 1, but showing the retaining member attached to the support body and illustrating the pivotal movement of the retaining member relative to the support body portion.
Figure 3:
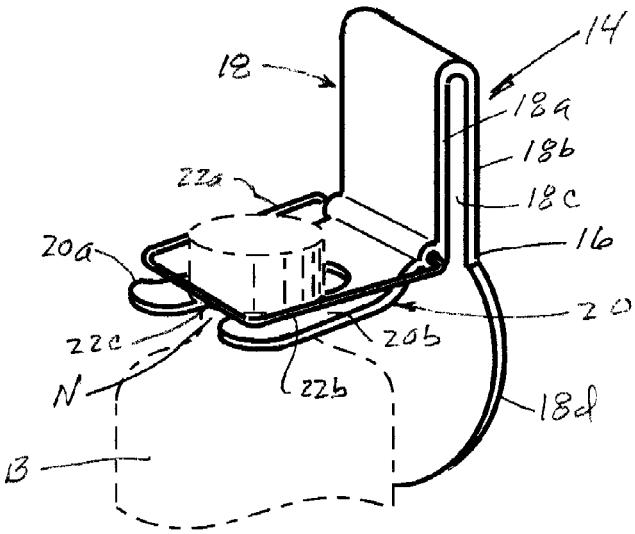
FIG. 3 is a generally perspective view of the bottle holder of the invention, showing in dotted lines a conventional bottle being supported by the bottle holder.

Referring to the drawings and particularly to FIGS. 1 through 3, one form of the bottle holder of the present invention for holding a bottle having a neck portion "N" and an enlarged diameter body portion "B" is there shown and generally identified by the numeral 14. Bottle holder 14 here comprises a one-piece, integrally formed support body 16 for supporting the bottle that includes a generally U-shaped clip portion 18 having first and second opposing sides 18*a* and 18*b* that cooperate to form a retention channel 18*c*. As illustrated in FIG. 2 of the drawings, first side 18*a* of the clip portion is of the first length, while second side 18*b* is of a second length greater than the first length. Connected to and extending downwardly from second side 18*b* is a rounded lower portion 18*d*.

Figure 4:
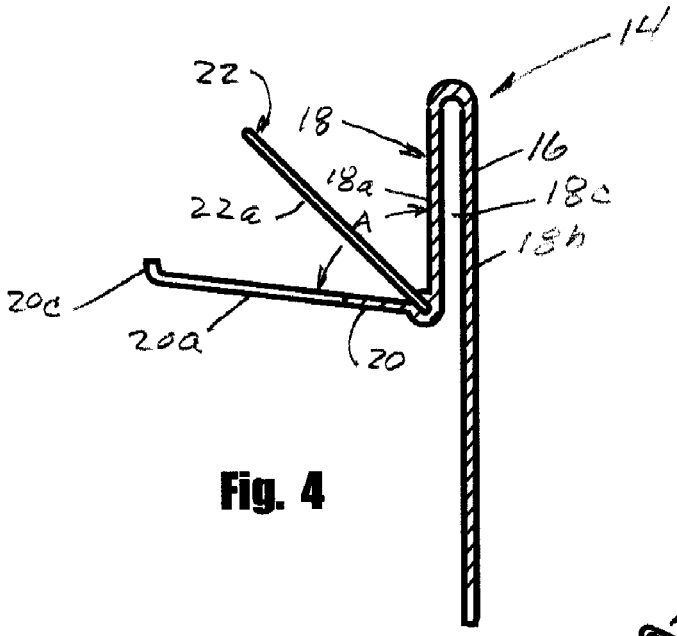
FIG. 4 is a cross-sectional view taken along lines 4-4 of FIG. 2.

Connected to and extending from the first side 18*a* of the clip portion 18 at an acute angle "A" of slightly less than 90° (FIG. 4) is a generally yoke shaped support portion 20 for receiving the neck portion of the bottle. As indicated in the drawings, generally yoke shaped support portion 20 includes a pair of spaced apart fork like portions 20*a* and 20*b* each of which is provided with an angularly upwardly extending end portion 20*c*. In use, end portions 20*c* tend to keep the bottle cap portion of the bottle from slipping out of the spaced apart fork like portions of the support portion 20. Support body 16 can be constructed from a metal, moldable plastic or any other suitable material.

An important feature of the bottle holder of the present invention is a generally U-shaped retaining member 22 that is pivotally connected to support body 20 for movement between the first upraised position shown in FIG. 2 of the drawings and a second lowered position shown in FIG. 3 of the drawings, wherein a portion of the retaining member circumscribes the neck portion of the bottle (see FIG. 3). More particularly, retaining member 22 includes a pair of spaced apart sides 22*a* and 22*b* that are pivotally connected to said support body and further includes a bight member 22*c* that is interconnected with the spaced apart sides and extends over the neck portion of the bottle when said retaining member is in the lowered position shown in FIG. 3 of the drawings. Retaining member 22 can be constructed from metal, moldable plastic or any other suitable material.

Figure 5:
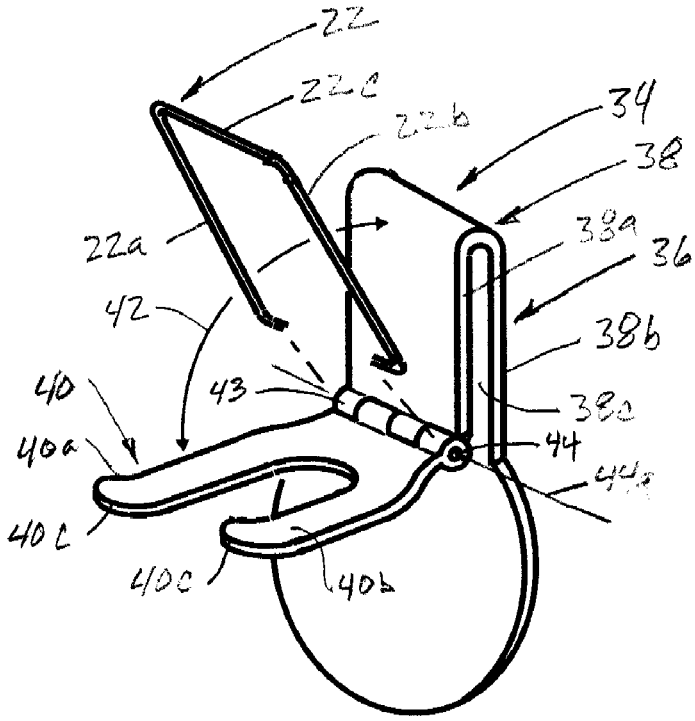
FIG. 5 is a generally perspective, exploded view of an alternate form of the bottle holder of the invention.

Turning now to FIG. 5 of the drawings, an alternate form of the bottle holder of the present invention for holding a bottle having a neck portion "N" and an enlarged diameter body portion "B" of the character shown in FIG. 3 is there shown and generally identified by the numeral 34. Bottle holder 34 is similar in many respects to the earlier described bottle holder and like numerals are used in FIG. 5 to identify like components. This latest form of the bottle holder comprises a support body 36 for supporting the bottle that includes a generally U-shaped clip portion 38 having first and second opposing sides 38*a* and 38*b* that cooperate to form a retention channel 38*c*. As in the earlier described embodiment of the invention, the first side 38*a* of the clip portion is of the first length, while second side 38*b* is of a second length greater than the first length. Connected to and extending downwardly from second side 38*b* is a rounded lower portion 38*d*.

Pivotally connected to and extending from the first side 38*a* of the clip portion 38 is a generally yoke shaped support portion 40 for receiving the neck portion of the bottle. As indicated in FIG. 5, generally yoke shaped support portion 40 includes a pair of spaced apart fork like portions 40*a* and 40*b*, each of which is provided with an angularly upwardly extending end portion 40*c*. In use, when the support portion 40 is in its lowered position as shown in FIG. 5, end portions 40*c* tend to keep the bottle cap portion of the bottle from slipping out of the spaced apart fork like portions of the support portion. Support body 36 can be constructed from a metal, moldable plastic or any other suitable material.

As indicated in FIG. 5 generally yoke shaped support portion 40 is pivotally movable in the direction of the arrow 42 about a hinge assembly 43 between the lowered position shown by FIG. 5 and a folded position where it is located proximate the first side 38*a* of the clip portion. In this stowed, folded position the bottle holder can be conveniently carried on the user's belt or clothing with minimum interference for normal activities. As indicated in FIG. 5, hinge assembly 43 here comprises a pivot pin 44 having an axis 44*a* about which the first side 38*a* of the clip portion pivots in the direction of the arrow 42. In the manner well understood by those skilled in the art, hinge assembly 43 is a constructed so that as the first side 38*a* of the clip portion moves downwardly it will be a locked into a fixed, lowered position wherein the first side of the clip portion defines an acute angle with respect to the second side of the clip portion.

An important feature of the bottle holder of this latest form of the invention is a generally U-shaped retaining member 22 that is pivotally connected to support body 36 for movement between a first upraised position and a second lowered position. As in the earlier described embodiment of the invention, when the retaining member 22 is in the lowered position the bight portion 22*c* of the retaining member circumscribes the neck portion of the bottle so as to secure it in position.

Having now described the invention in detail in accordance with the requirements of the patent statutes, those skilled in this art will have no difficulty in making changes and modifications in the individual parts or their relative assembly in order to meet specific requirements or conditions. Such changes and modifications may he made without departing from the scope and spirit of the invention, as set forth in the following claims.

I claim:

1. A bottle holder for holding a bottle having a neck portion and an enlarged diameter body portion comprising:

(a) a support body for supporting the bottle including:

(i) a generally U-shaped clip portion having first and second opposing sides that cooperate to form a retention channel; and (ii) a generally yoke shaped support portion for receiving the neck portion of the bottle, said yoke shaped portion being connected to end extending from said first side of said clip portion; and (b) a retaining member pivotally connected to said support body for movement between a first upraised position and a second lowered position wherein said retaining member circumscribes the neck portion of the bottle.

2. The bottle holder as defined in claim 1 in which said generally yoke shaped support portion is integrally formed with said first side of said clip portion and extends there from an acute angle.

3. The bottle holder as defined in claim 1 in which said generally yoke-shaped support portion is pivotally connected to said first side of said clip portion for movement between a first lowered position and a second stowed position.

4. The bottle holder as defined in claim 1 which said generally yoke shaped support portion is provided with an angularly upwardly extending end portion.

5. The bottle holder as defined in claim 1 which said retaining member is generally U-shaped and includes a pair of spaced apart sides that are pivotally connected to said support body portion and further includes a bight member that is interconnected with the spaced apart sides and extends over the neck portion of the bottle when said retaining member is in said second lowered position.

6. A bottle holder for holding a bottle having a neck portion and an enlarged diameter body portion comprising:

(a) a support body for supporting the bottle including:

(i) a generally U-shaped clip portion having first and second opposing sides that cooperate to form a retention channel; and (ii) a generally yoke shaped support portion for receiving the neck portion of the bottle, said yoke shaped portion having spaced apart, angularly upwardly extending extremities and being connected to and extending from said first side of said clip portion; and (b) a generally U-shaped retaining member having a bight portion and spaced apart sides connected to said bight portion, said spaced apart sides being pivotally connected to said support body for movement between a first upraised position and a second lowered position wherein said bight portion of said retaining member extends over the neck portion of the bottle.

7. The bottle holder as defined in claim 6 in which said generally yoke-shaped support portion is pivotally connected to said first side of said clip portion for movement between a first lowered position and a second stowed position.

8. The bottle holder as defined in claim 6 in which said generally yoke shaped support portion is integrally formed with said first side of said clip portion.

9. The bottle holder as defined in claim 8 in which said generally yoke shaped support portion extends from said first side of said clip portion at an acute angle.

10. The bottle holder as defined in claim 9 in which said first side of said clip portion is of the first length and in which said second side of said clip portion is of a second length greater than said first length.

11. The bottle holder as defined in claim 10 in which said body portion is constructed from a moldable plastic.

12. The bottle holder as defined in claim 11 in which said retaining member is constructed from a metal.

13. A bottle holder for holding a bottle having a neck portion and an enlarged diameter body portion comprising:

(a) a support body for supporting the bottle including:

(i) a generally U-shaped clip portion having first and second opposing sides that cooperate to form a retention channel, said first side being of a first length and said second side being of a second length greater than said first length; and (ii) a generally yoke shaped support portion for receiving the neck portion of the bottle, said yoke shaped portion having spaced apart, angularly upwardly extending extremities and being connected to and extending from said first side of said clip portion; and (b) a generally U-shaped retaining member having a bight portion and spaced apart sides connected to said bight portion, said spaced apart sides being pivotally connected to said support body for movement between a first upraised position and a second lowered position wherein said bight portion of said retaining member extends over the neck portion of the bottle.

14. The bottle holder as defined in claim 13 in which said generally yoke-shaped support portion is pivotally connected to said first side of said clip portion for movement between a first lowered position and a second stowed position.

15. A bottle holder for holding a bottle having a neck portion and an enlarged diameter body portion comprising:

(a) a support body for supporting the bottle including:

(i) a generally U-shaped clip portion having first and second opposing sides that cooperate to form a retention channel; and (ii) a generally yoke shaped support portion for receiving the neck portion of the bottle, said yoke shaped portion being connected to end extending from said first side of said clip portion; and (b) a retaining member pivotally connected to said support body for movement between a first upraised position and a second lowered position wherein the neck portion of the bottle is received within said retaining member and wherein said retaining member circumscribes the neck portion of the bottle.

16. The bottle holder as defined in claim 15 which said retaining member is generally U-shaped and includes a pair of spaced apart sides that are pivotally connected to said support body portion and further includes a bight member that is interconnected with the spaced apart sides and extends over the neck portion of the bottle when said retaining member is in said second lowered position.

17. The bottle holder as defined in claim 15 in which said generally yoke shaped support portion extends from said first side of said clip portion at an acute angle.

* * * * *